US005165592A

United States Patent [19]

Wasikowski

[11] Patent Number: 5,165,592

[45] Date of Patent: Nov. 24, 1992

[54] METHOD OF MAKING REFINER PLATE BARS

[75] Inventor: Paul Wasikowski, Cudahy, Wis.

[73] Assignee: J & L Plate, Inc., Waukesha, Wis.

[21] Appl. No.: 861,309

[22] Filed: Mar. 31, 1992

[51] Int. Cl.[5] ..... G23R 20/00

[52] U.S. Cl. ..... 228/195; 419/9; 419/40

[58] Field of Search ..... 228/195; 419/9, 40

[56] References Cited

U.S. PATENT DOCUMENTS

| | | | |
|---|---|---|---|
| 4,023,739 | 5/1977 | Lampe et al. | 241/296 |
| 4,227,927 | 10/1980 | Black et al. | 75/225 |
| 4,581,300 | 4/1986 | Hoppin | 228/193 |
| 4,587,707 | 5/1986 | Nishida et al. | 29/527.7 |
| 4,614,296 | 9/1986 | Lesgourgues | 228/194 |
| 4,670,215 | 6/1987 | Morishita et al. | 419/9 |
| 4,745,254 | 5/1988 | Funk | 219/76.15 |
| 4,837,417 | 6/1989 | Funk | 219/76.15 |
| 4,980,123 | 12/1990 | Gedeon et al. | 419/8 |

*Primary Examiner*—Stephen J. Lechert, Jr.
*Attorney, Agent, or Firm*—Willis B. Swartwout, III

[57] ABSTRACT

The present invention is a method of molding the cutter bars for refiner plates used in treating pulp slurry in the paper processing industry including impressing in a mold the form of a refiner plate or refiner plate segment, pouring the base plate or pouring the base of the refiner base plate segment. The sand surfaces in the mold which will be in contact with the metal to form the perpendicular surfaces of the cutter bars relative to the refiner plate are then treated with a slurry consisting of an alcohol or water carrier into which powdered brittle metal alloys have been introduced such as titanium, boron, carbon, vanadium, chromium, niobium, tungsten, molybdenum and cobalt 10 microns or less in size in the pure or ferro alloy state. The powdered metal alloy slurry is then dried in one of a number of acceptable ways and the cutter bar base metal is then superheated to a temperature higher than its melting point, after which the molten metal is poured into the mold. The superheating and the cooling of the mold diffuse the powdered metal alloys evenly into the cutter bar base metal that touches the treated sand surfaces, the carrier evaporates. After appropriate cooling time, usually 4 to 8 hours, the molded refiner plate or plate segment may be heat treated to further insure deep and even penetration of the powdered metal alloy and the parallel surfaces of the cutter bar to the refiner plate may be machined to form a perfect right angle edge.

10 Claims, 2 Drawing Sheets

METHOD OF MAKING REFINER PLATE BARS

BACKGROUND OF THE INVENTION

Comminuting discs having refiner plate bars for cutting and shredding the fibre in pulp slurry are in common use in the paper processing industry. A substantial amount of cost and time delay is involved every time a paper processing machine is down for the sharpening or replacement of the blades or edges on the comminuting bars.

It is, therefore, desirable to reduce the down time to a minimum by providing blades or edges on the bars that are self-sharpening and require replacement less often. Since friction is a major source of wear of the blades or edges, one of the methods that has been tried in the paper processing industry is to make the blades or edges of the bars from an alloy. The alloy may be hardened or very resistant to the friction incurred in the course of processing many gallons of the pulp slurry.

Eventually the wear will, however, become such as to render the blade edge no longer usable or to require re-sharpening of the edge. One way to keep the blade or edge usable for a longer period of time is to form the alloy from two materials, at least one of which is harder and/or more resistant to friction than the other. This has been tried with varying degrees of success in cutting implements by applying in one form or another such as spraying etc. an abrasive material on one of two surfaces that frictionally engage each other a material which will sharpen the edge on the other surface in the course of normal use. This works satisfactorily until the abrasive material wears away.

Another method that has been tried for producing the blades or edges is to mold them from an alloy comprised in part by a traditional metal such as steel and an alloy powder containing titanium, boron, carbon, vanadium, and the like in powder form. This does aid in producing a long lasting blade or edge but it is prohibitively expensive to mold an entire blade in this fashion. These powder alloys are metals that are ordinarily too brittle to use except in some form of alloy wherein the base metal is of a softer type. The softer metal wears away faster thereby providing the possibility for self-sharpening.

SUMMARY OF THE INVENTION

The present invention proposes to overcome the various problems of the prior art by forming an edge or blade for a comminuting refiner plate bar by first molding the base of the plate in a normal fashion, and then isolating the cutting edge area of the plate within a mold, into which is introduced alloying elements which are diffused during the pouring, solidification, and cooling stages of pouring the base metal of the alloy at a temperature greater than the normal melting temperature of the alloy base metal of the metal casting process of the cutting edge area.

It is another object of the present invention to provide in the method above described the production of a hard case surface without adding additional processing steps after the initial casting.

It is still another object of the present invention to provide in the method above described the ability to use otherwise embrittling alloying elements to improve wear properties by modifying the working surface without changing the base properties of the material.

It is a further object of the present invention to provide in the method above described the reduction of the amount of the costly alloying elements to affect the performance of the material by selectively applying the alloying element only to the working surface.

It is yet a further object of the present invention to provide in the method above described the ability to introduce into the mold area cutter bar working special surface, an alloy powder mixed with a mold coating, singularly or in combination with other alloy powders in the form of a slurry applied to the mold surface, the alloy powder or powders diffused as desired by the subsequent introduction of the molten metal base material at a temperature well above the melting point of the material.

It is still a further object of the present invention to apply the alloy slurry which includes a water or an alcohol carrier containing one or more alloy powders such as titanium, boron, carbon, vanadium, chromium, niobium, tungsten, molybdenum and cobalt or the like, by such processes as brushing, spraying, swabbing or flow coating and then drying the slurry either through the passage of time or the introduction of warm air drying flow.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
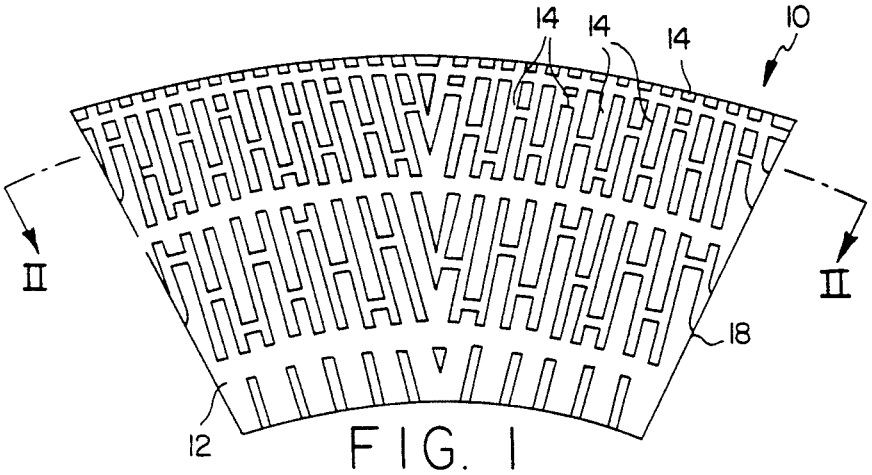
FIG. 1 shows an arcuate segment of a refiner face plate of a well known design in top plan view.

Referring now to the drawings and more particularly to FIG. 1 thereof a refiner plate arcuate segment is shown and generally identified by the numeral 10. As can be seen from this view of the drawings, refiner plate arcuate segment 10 has on its upper surface 12 a plurality of cutter bars or blades 14.

Not shown in the drawings, but to be understood by the reader, a plurality of refiner plates 10 are affixed in a suitable fashion to one face of a generally circular disk mounted on a hub to rotate therewith. A sufficient number of plates 10 are mounted on the disc to form a full circle of arcuate segment plates 10.

A second disc having refiner plates 10 is mounted in axially spaced relationship to the first disc with its plate segments 10 facing the plate segments 10 of the first disc, but spaced sufficiently axially so that the plates 10 of both discs do not actually touch.

At this time it is well to understand that the term slurry will be used in several ways herein. The term pulp slurry is intended to refer to a liquid in which is suspended fibres of wood pulp for processing into paper. The term slurry may also be used from time to time to refer to a carrier slurry made from a carrier of either water or alcohol or the like into which has been introduced one or more powder alloy elements.

Figure 2:
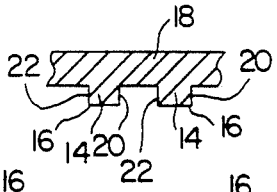
FIG. 2 is a fragmentary vertical cross-sectional view of the structure shown in FIG. 1 along line II—II of FIG. 1.
Figure 3:
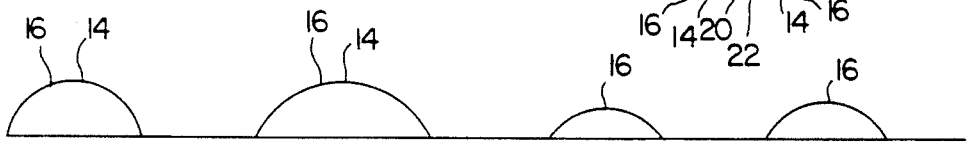
FIG. 3 is an enlarged fragmentary view similar to FIG. 2 showing the affects of wear on the cutting bars of the refiner face plate segment resulting from use.

Referring now to FIGS. 2 and three of the drawings a plurality of spaced cutter bars 14 are shown. Note that in FIG. 2 the cutter bars 14 are generally rectangular in vertical cross-sectional dimension while in FIG. 3, the top surface or upper surface 16 of bar 14 is worn away. FIG. 2 shows the cutter bar 14 as it is in its brand new state with side surfaces 20 and 22 forming a right angle with upper surface 16. FIG. 3 shows the cutter bar 14 as it looks after pulp fibre has worn it away in the comminuting process.

Figure 4:
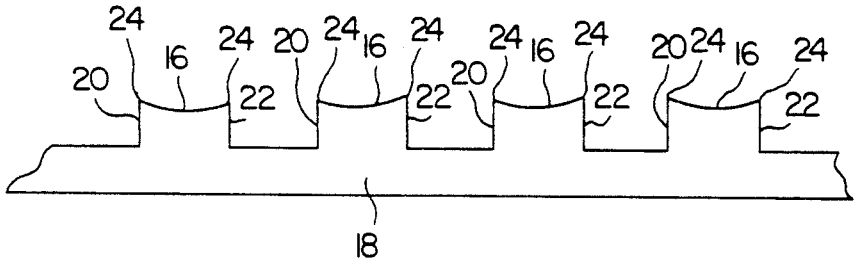
FIG. 4 is a view similar to FIG. 3 showing the affects of wear on the cutting bars of a refiner face plate made according to the present invention.

FIG. 4 of the drawings illustrates how the bars 14 would be shaped after some wear, if the bars 14 are formed according to the present invention. Note that upper surface 16 of bars 14 is generally concave as viewed in vertical cross-section, resulting in sharp edges or blades 24.

The present invention proposes a mold (not shown) comprised of a cope (not shown) and a drag 26 into which the form 28 for an arcuate refiner plate segment 10 has been impressed. A pattern (not shown) is used to impress the complete form of a segment 10 into the cope and drag. The arcuate cutter bar base 18 is prepoured and after any finishing required is placed or replaced as the case may be into the mold in such a fashion that when the cope and drag are assembled to each other the shape of the cutter bars 14 will be defined by the sand 30 but unfilled.

Figure 5:
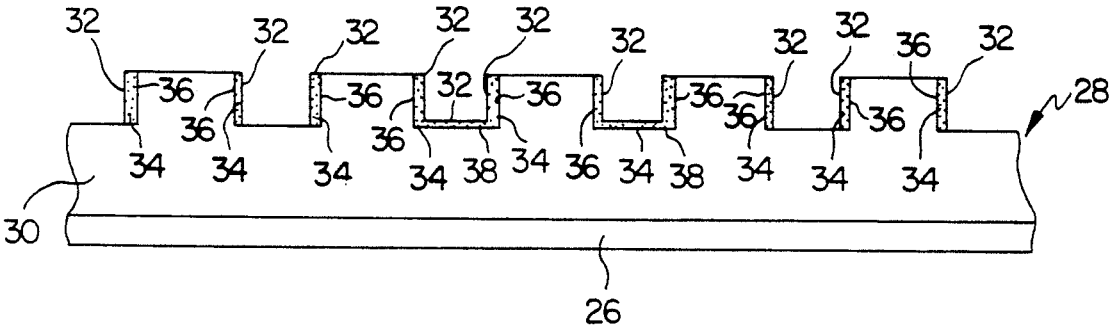
FIG. 5 is a fragmentary vertical cross-sectional view through a cope or drag portion of a mold, showing a portion of the pattern impressed surface of a cutter bar in the sand and illustrating the surfaces to be treated.

After the form is made in the cope and drag but before the cope and drag are assembled a carrier slurry generally identified in FIG. 5 by the numeral 32 is formed from a fluid such as water or alcohol into which one or more powdered alloy materials 34 may be introduced. The powder alloys will come from a group which for this purpose includes but should not necessarily be limited to titanium, boron, carbon, vanadium, chromium, niobium, tungsten, molybdenum and cobalt, in the pure and ferro alloy states of a size of ten microns or less. The particular combination of base metal and alloy powder is determined by the desired properties of the resulting alloy. Since the portion of the mold into which the metal base for the alloy will be introduced can be isolated, only the vertical surfaces 36 of the cutting edges or blades of the mold into which the base metal will be introduced need be treated with the carrier slurry 34. The carrier slurry 34 may be applied by brushing, spraying, swabbing or flow coating, after which the thus treated surfaces may be air dried or dried by the introduction of warm air or other forms of heating. Other possibilities are heating with infra red light, microwave ovens or burning. Note that in FIG. 5 of the drawings, there is disclosed the fact that the form surface 38 may also be treated if hardening of the surface would be desired, however that would likely defeat the self-sharpening result of the present invention.

After the cope and drag are re-assembled into the mold the base metal of the bar 14, usually, but not limited to, a stainless steel, high chromium steel or alloy steels is introduced into the mold at a temperature in excess of the temperature required to melt the base metal of the cutter bar. This is often referred to as super heating the base metal. The base metal poured into the mold at superheated temperatures will vaporize the carrier and diffuse the powder alloy evenly in the surfaces where there is contact between the molten metal and the treated mold surfaces.

The mold is then allowed to cool for a period of from 4 to 8 hours, the longest possible cooling time being preferable if time constraints do not otherwise dictate, after the segment 10 is removed from the mold and the top surface 16 may be machined to form a perfect right angle with side surfaces 20 and 22. The segment 10 may be treated in some fashion such as heat treating before the grinding of upper surface 16 to obtain different properties of the base material if desired. Solidification of the metal in the mold may only taken an hour and cooling time may then be varied thereafter but 8 hours is usually considered optimum. If the casting does not require manual handling heat treating or machining may be done any time after solidification takes place.

The final casting may be used in the "as cast" condition but heat treating increases the diffusion of the alloy and the alloy distribution will be more homogenous and the depth of penetration will increase. In FIG. 5 the powder alloy is indicated by the numeral 40.

It is significant that this process allows the use of very brittle powdered metals in the alloys which otherwise would not be usable to achieve a self-sharpening edge, in other words wear resistance and breakage resistance are normally inconsistent properties of metal alloys.

I claim:

1. The method of molding cutter bars for refiner plates or the like including the steps of:

a) forming the shape of a refiner plate including cutter bars in a mold;

b) pouring the refiner plate base portion;

c) treating cutter bar mold surfaces disposed perpendicular to said plate base with a slurry containing a powdered metal alloy;

d) drying said powdered metal alloy slurry;

e) heating cutter bar base metal to a temperature greater than its melting temperature and f) pouring the molten cutter bar base metal into the mold.

2. The method as set forth in claim 1, wherein the step of treating the cutter bar mold surfaces is accomplished by applying the slurry in one of the manners selected from the group including spraying, swabbing, brushing and flow coating to a treatment coat thickness of aproximately 20 microns in thickness.

3. The method as set forth in claim 1, wherein the step of drying the powdered metal alloy slurry may be accomplished in one of the manners selected from a group including infra red heating, micro wave heating, burning, forced hot air drying and atmospheric drying.

4. The method as set forth in claim 1, wherein there is added the additional step or removing the cooled pouring from the mold and heat treating it.

5. The method as set forth in claim 1, wherein there is the additional step of removing the cooled pouring from the mold and machining it.

6. The method as set forth in claim 1, wherein the step of treating the cutter bar mold surfaces includes preparing a slurry comprising a carrier and a powdered metal alloy.

7. The method as set forth in claim 6, wherein the carrier is selected from a group of carriers including alcohol and water.

8. The method as set forth in claim 6, wherein the powdered metal alloy is selected from a group of powdered metal alloys including titanium, boron, carbon, vanadium, chromium, niobium, tungsten and molybdenum.

9. The method as set forth in claim 6, wherein the powdered metal alloy selected is in the pure state.

10. The method as set forth in claim 6, wherein the powdered metal alloy selected is in the ferro alloy state.

* * * * *